United States Patent [19]

Zofan et al.

[11] Patent Number: 4,684,927

[45] Date of Patent: Aug. 4, 1987

[54] ANNUNCIATOR CIRCUIT FOR ELEVATOR SYSTEMS

[75] Inventors: Ely S. Zofan; Marlin O. Thurston, both of Columbus, Ohio

[73] Assignee: Floyd Bell Associates, Inc., Columbus, Ohio

[21] Appl. No.: 865,152

[22] Filed: May 20, 1986

[51] Int. Cl.[4] ..... G08B 3/00

[52] U.S. Cl. ..... 340/384 E

[58] Field of Search ..... 340/384 E, 384 R

[56] References Cited

U.S. PATENT DOCUMENTS 4,193,060 3/1980 Slavin et al. ..... 340/384 E X 4,257,036 3/1981 Slavin et al. ..... 340/384 E X 4,558,305 12/1985 Black et al. ..... 340/384 E

*Primary Examiner*—Stewart J. Levy

*Assistant Examiner*—Joseph W. Roskos

*Attorney, Agent, or Firm*—Mueller and Smith

[57] ABSTRACT

A highly reliable annunciator circuit which is immune from spurious signals generated in an elevator environment is provided. The circuit employs an input condition verification network which performs in conjunction with low true logic two-bit inputs by carrying out switching only when those inputs fall below a preset control value, highly enhanced performance is achieved. Volume control over the piezoelectric output developing a chime or gong sound is achieved through a variable impedance control which is adjustable on site.

18 Claims, 3 Drawing Figures

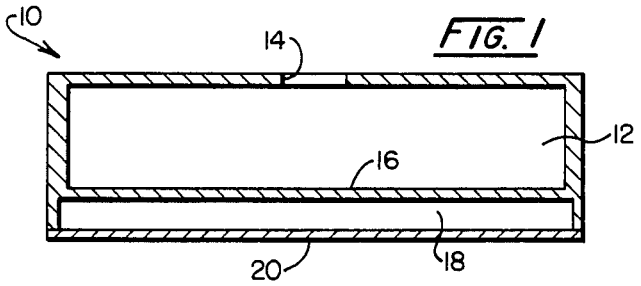
FIG. 1
FIG. 2A
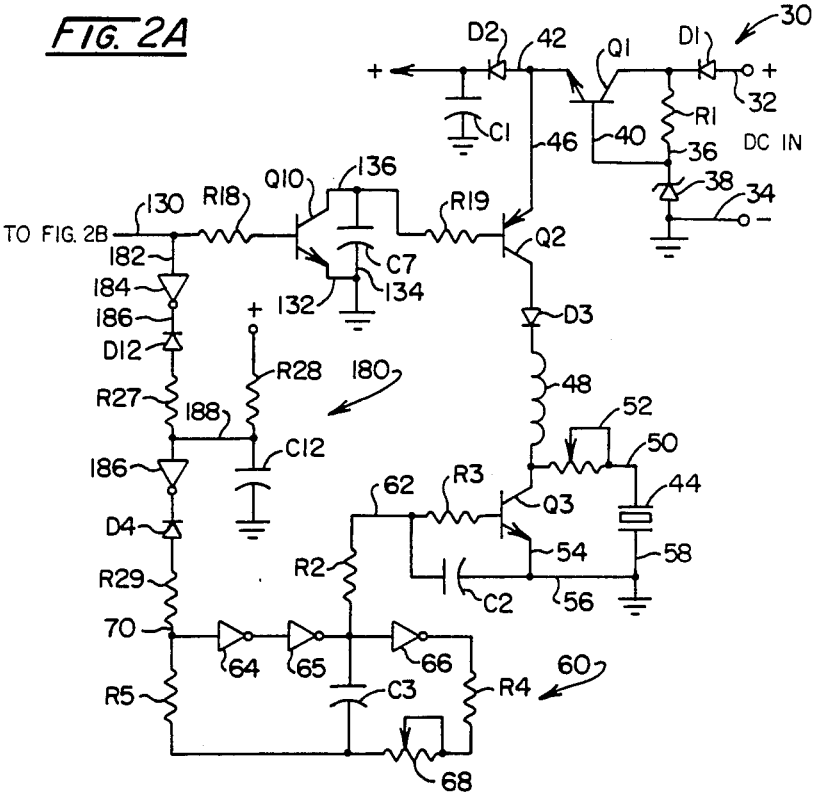

ANNUNCIATOR CIRCUIT FOR ELEVATOR SYSTEMS

BACKGROUND OF THE INVENTION

The elevator industry traditionally has provided some form of annunciator or "sounder" function in conjunction with each landing serviced by an elevator car. Early versions of these annuciator devices were electro-mechanical in nature, a bell being actuated to indicate arrival of the car at a given floor station. These electro-mechanical devices were prone to break-down and eventually have been phased out in favor of electronic approaches to the function.

Loudspeakers of conventional design have been suggested for employment in each car and at each floor landing to announce arrivals. However, disadvantages are attendant with their use. The loudspeakers are driven by an oscillator in a manner mimicking a chime. For example, one chiming sound may represent that the elevator is progressing in an upwardly direction, while two chimes would indicate that the elevator is downwardly progressing. Similarly, a sequence of singular chimes may indicate that the door is being held open for an unduly lengthy period of time.

Because of the broad frequency response and the low resonance characteristics of loudspeakers, they readily have been capable of producing quality chime sounds. However, because loudspeakers are formed of paper cones and the like, they are prone to damage in the environment of elevators, which is more rigorous than may be expected. For example, vandalism, moisture, and excessive dirt when combined with the very dynamic conditions extant at the elevator shaft will cause their breakdown at an unacceptably high level.

Recently, the industry has turned to the use of piezoelectric crystal driven sounders having the promise of much improved durability when employed in this elevator environment. In using these devices, however, several undesirable characteristics of their operation had to be overcome. In this regard, the piezoelectric driven devices are highly resonant during several modes of their performance, depending upon the wave pattern of the diaphragms to which they are attached. Thus, the development of a desired chime sounding, as for example a "gong" becomes difficult to achieve. A gong-like sound requires a decaying amplitude drive at lower frequencies which have proven difficult to develop. However, improved lower frequency outputs have been achieved through resort to dual chamber sound box structures designed following Helmholz theory.

When employed in the environment of the elevator shaft, however, these devices have been prone to react to unusual spurious electrical phenomena to falsely actuate. Attempts at isolating the causes of such spurious phenomena have not been particularly successful, perhaps due to the extreme length of typical elevator shafts and the related dynamics of the elevator within that shaft environment.

SUMMARY

The present invention is addressed to annunciator circuits and, particulary to those suited for use with an elevator system of a variety wherein a piezoelectric crystal is energized to drive the diaphragm of a sounder. The system works in response to the two-bit logic low true input conditions of an overall elevator system control. Through the use of an input condition verification network including first and second switching arrangements which are respectively responsive to low logic conditions of first and second ones of the two-bit conditions only when those low true conditions are below a predetermined signal value, there is achieved a reliability in the system which provides first and second unique verified low true signals that are highly reliable for control over the chime output sound function.

Through the use of variable impedance control intermediate the power supply and piezoelectric crystal, an ideal locally adjustable volume control is achieved. Further, by combining the noted input condition verification network with an oscillator disabling circuit function which positively performs in disabling the oscillator to the piezoelectric crystal in the presence of dual logic high input levels to the system, added reliability is enhanced.

The invention, acccordingly, comprises the apparatus possessing the construction, combination of elements, and arrangement of parts which are exemplified in the following detailed disclosure.

For a fuller understanding of the nature and objects of the invention, reference should be had to the following detailed description taken in connection with the accompanying drawings.

BRIEF DESCRIPTION OF THE DRAWINGS

FIG. 1 is a sectional schematic view of a dual chambered sound enhancement device as may be employed with the instant invention; and FIGS. 2A and 2B combine in side-by-side relationship to represent a schematic electrical circuit of the instant invention.

DETAILED DESCRIPTION

Figure 2B:
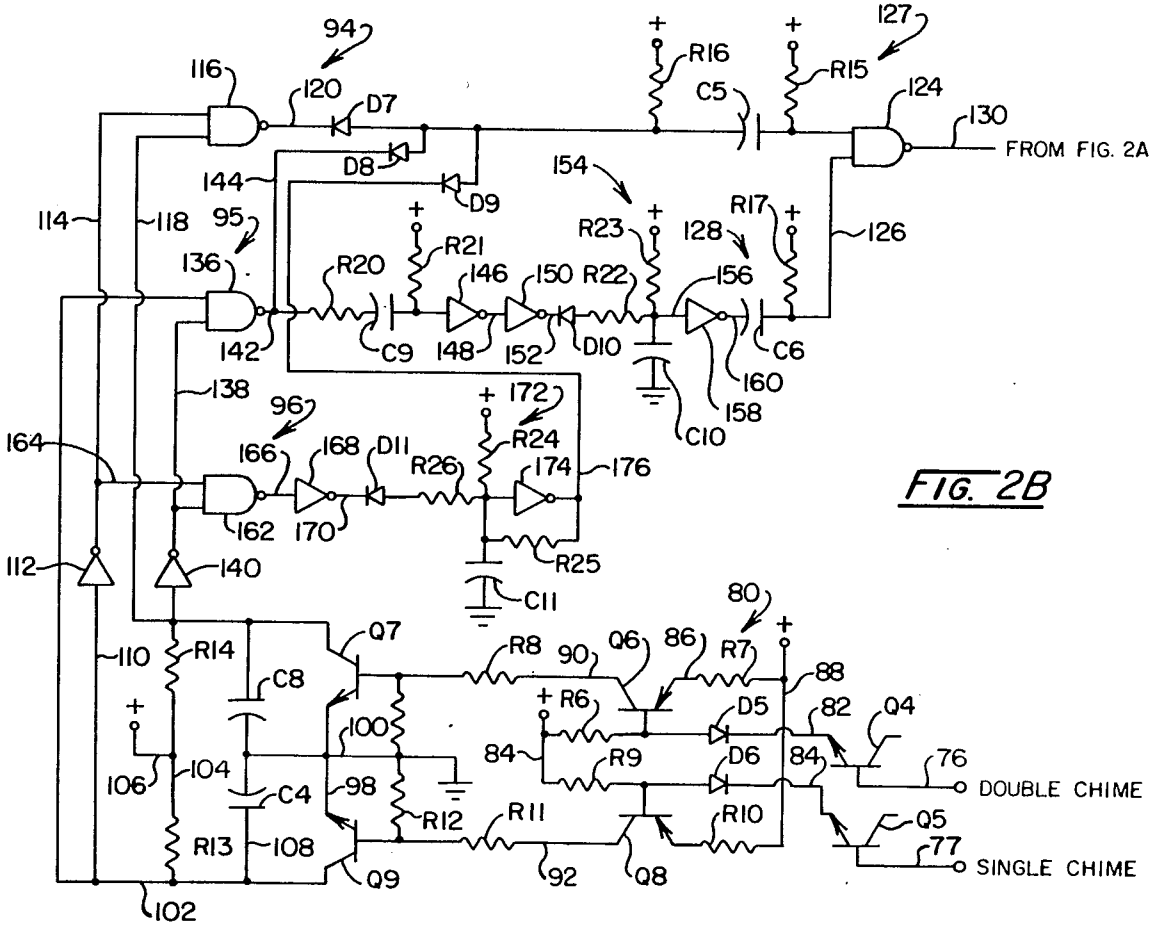

Referring to FIG. 1, a sound box which may be employed with a piezoelectric crystal driven diaphragm to achieve an accentuation of lower level frequencies and a dimunition of higher frequencies is revealed generally at 10. The sound box 10 includes a first acoustical cavity 12 having an aperture formed therein as represented at 14. The lowermost portion of the cavity 12 is defined by a driven diaphragm 16 which, additionally, serves as one side of a second acoustical cavity as represented at 18. Cavity 18 also is formed having an aperture therein at 20 and the arrangement is so designed in accordance with Helmholz theory that the desired low frequency enhancement and high frequency dimunition is achieved. Generally, the sound box 10 is, in turn, enclosed within a second container which further serves to reduce higher frequency levels. In effect, the case or the like which holds not only the sound box 10 but also supportive electrical circuitry forms a third cavity which, while not being designed acoustically to a particular frequency, effects an attenuation of higher frequencies which is a desirable attribute to rid the system of frequencies considered harsh in terms of sound while accentuating a more pleasant low frequency. When a sequence of nine such sound boxes at 10 were tested with a signal generator over a range of frequencies and in open air, the desirable enhancement of lower range frequencies and dimunition of higher range frequencies has been achieved. Looking at the tabulation below, the results of these tests are revealed, resonant frequencies which were developed being recorded along with the output in decibels of the devices. With such responses, a desirable "gong" form of output sound may be achieved by employing a drive to the piezoelectric crystal having an exponentially decaying amplitude drive.

TABLE

| Unit | f | dB | f | dB | f | dB | f | dB | f | dB | f | dB |
|---|---|---|---|---|---|---|---|---|---|---|---|---|
| 6 | 360 | 7.0 | 735 | 14.5 | 1426 | 18.5 | 2062 | 29.0 | 3158 | 10.0 | 8205 | 20.0 |
| T1 | 454 | 13.0 | 726 | 19.5 | 1409 | 18.0 | 2362 | 29.5 | 3649 | 21.5 | 9548 | 29.5 |
| T2 | 429 | 13.0 | 718 | 19.5 | 1357 | 18.5 | 2300 | 32.0 | 3639 | 18.5 | 9165 | 26.0 |
| T3 | 414 | 12.5 | 715 | 19.0 | 1351 | 13.5 | 2253 | 31.5 | 3630 | 18.0 | 8963 | 24.0 |
| T4 | 428 | 12.0 | 722 | 19.0 | 1377 | 15.0 | 2345 | 31.0 | 3700 | 16.0 | 9327 | 27.0 |
| T5 | 429 | 12.5 | 725 | 19.5 | 1382 | 15.0 | 2369 | 31.5 | 3637 | 19.0 | 9350 | 26.0 |
| T6 | 454 | 13.0 | 725 | 20.0 | 1385 | 15.0 | 2438 | 30.5 | 3654 | 21.5 | 9555 | 36.5 |
| T7 | 425 | 13.0 | 719 | 19.0 | 1368 | 15.0 | 2290 | 32.0 | 3631 | 19.0 | 9126 | 28.0 |
| T8 | 451 | 13.0 | 727 | 20.0 | 1391 | 15.0 | 2376 | 32.0 | 3628 | 19.5 | 9559 | 36.0 |
| T9 | 436 | 14.0 | 726 | 20.5 | 1426 | 14.5 | 2376 | 32.0 | 3660 | 20.5 | 9562 | 35.0 |

Turning to FIGS. 2A and 2B, a circuit employing noise immune features under which the piezoelectric chamber arrangement may perform in an elevator environment is revealed in detail. Figure 2A should be read in conjunction with FIG. 2B as representing a laterally positioned right side of the total drawing. In FIG. 2A, power supply regulator function is revealed generally at 30 which is coupled to a 24 volt d.c. power supply of a conventional elevator control system via input lines 32 and 34. A diode D1 in line 32 functions as a polarity protector. Line 32 extends to the collector of an NPN transistor Q8, the base of which is coupled via line 40 to line 36 at a point intermediate diode 38 and resistor R1. Line 34 is coupled with line 36 extending between line 32 and ground. Line 32 contains a Zener diode 38 providing for a 15 volt regulation and a bias resistor R1. This 15 volts provide regulated input to the base of transistor Q1. The emitter of transistor Q1 extends via line 42 and diode D2 to a secondary regulation circuit which includes a capacitor C1. Diode D2 and capacitor C1 at line 42 provide an enhanced regulation for the power supply of the logic circuit components described hereinafter, by isolating it from drive currents to the annunciator components.

The initially regulated power supply of 15 volts at line 24 is used for the purpose of driving a piezoelectric crystal 44 which may be mounted as described in conjunction with the diaphragm 16 shown in FIG. 1. In this regard, power for amplitude drive to the crystal is derived from line 46 which extends from line 42 to the emitter of a PNP transistor Q2. The collector of transistor Q2 is coupled via a diode D3 and inductive coil 48 to the collector of NPN transistor Q3 as well as line 50 including a potentiometer 52 to one side of piezoelectric crystal 44. The emitter of transistor Q3 is coupled via line 54 to line 56 which extends, in turn, to the opposite side of crystal 44 via line 58 and to the ground. Drive to the transistor Q3 at the base thereof extends from an oscillator circuit represented generally at 60 and having a frequency controlling input at line 62 extending from the oscillator 60 through resistor R2 and current limiting resistor R3 to the base of the transistor. A capacitor C2 within line 56 extending to line 62 cooperates with resistor R28 to develop a "rounding" effect of the harmonics rich square wave otherwise emanating from the oscillator network 60. This improves the quality of the sound which is generated from crystal 44 as regulated in frequency from transistor Q3.

Oscillator network 60 is conventionally formed including capacitor C3, inverter stages 64-66 and resistors R4 and R5. A frequency adjustment for this standard oscillator circuit may be provided by a potentiometer 68. Enablement of the network 60 is determined by the logic stage of line 70. When this logic state is such that diode D4 is back biased, then the network 60 is enabled to develop appropriate drive frequencies to the base of transistor Q3 through line 62.

Looking to the drive asserted at crystal 44, coil 48 functions to increase the voltage which may be applied thereto. Since the higher frequencies resonances have been damped for the instant application, the piezoelectric crystal employed requires about 50 to 70 volts drive input to provide an appropiate sound volume. To achieve that volume from the relatively lower power supply available at line 46, advantage is taken of the Ldi/dt characteristic of the coil to generate this higher voltage. Diode D3, cooperating with coil 48 functions to store drive energy asserted from line 46 through coil 48 at such time as transistor Q3 turns off. As that occurs, the resultant high spike is stored for employment as the drive input to crystal 44.

The volume control achieved by potentiometer 52 has been found to be quite valuable for such circuits now presented. In this regard, in many applications, for example in high rise condominiums and apartments, it is most desirable that the sound amplitude be very low, particularly during evening hours. On the other hand, for elevator installations as may be provided in active business offices or in department stores, the opposite conditions obtain. Thus, it becomes quite valuable for the owners of such installations to have the option to alter the sound level output not only as a function of general usage, but as a function of the period of utilization during any given day.

Referring to FIG. 2B, an input is provided to the instant annunciator circuit via lines 76 and 77 from the elevator control system. As part of the feature of avoiding spurious signal actuation of the circuit, the logic input applied at lines 76 and 77 is one which is low true, such an arrangement having been found to improve error free performance of the system. For the logic input, two bits of information are established at lines 76 and 77 and thus, in binary parlance there are four states. These four states are: single chime, double chime, continuous chime, and off. In accordance with the present invention, a positive state exists is developed the latter condition. Thus, the condition of "quiet" or off is in effect, made to be a positive (logic high) condition.

For the instant embodiment, a logic low at the line 76 in conjunction with an open condition at line 77 will indicate a downward progress of an elevator car and call for the generation of a double chime. Conversely, where a logic low is present at line 77 and a logic high is developed or forced on the occasion of an open condition at line 76, then a situation is indicated wherein the elevator car is in an upward progress and a single chime is commanded. Where logic low values are simultaneously applied to lines 76 and 77, then a condition wherein the elevator car door is open an excessive interval of time is called for and a continuous chime is required. Finally, where both lines 76 and 77 exhibit logic high values, then an active command for quiet is present in the system. The logic low signals applied at lines 76 and 77 may be of a very short duration, for example within a range of from a few microseconds to about 100 microseconds.

To assure that a low-going signal at lines 76 and 77 is valid and to avoid improper annunciation, a validation network is provided as represented in general at 80. Looking initially at line 76, the network 80 includes an open collector NPN transistor Q4 the base of which is coupled to line 76 and the emitter of which is coupled to line 82 which extends, in turn, through diode D5 to the base of PNP transistor Q6. Line 82 also extends through resistor R6 to plus power supply at line 84. This logic high value is employed to "force" an active logic high into the control circuit under quiescent conditions. The emitter of transistor Q6 is coupled to line 86 which extends through resistor R7 to line 88 also carrying plus power supply. The collector thereof at line 90 extends through bias resistor R8 to the base of NPN transistor Q7. With the arrangement shown, when a low-going signal of adequate value is presented at line 76, transistor Q3 will be drawn into conduction to present a positive-going bias input at line 90 to the base of transistor Q7 through resistor R8. The level of required low true signal at line 76, however, is controlled by the voltage drop effected by diode D5 and transistor Q4. Because of its open collector configuration with the emitter-base junction reverse-biased, ,transistor Q4 behaves as a Zener diode and thus, assuming a 15 volt power supply, the low true value at line 76 must be below about 5 volts with respect to ground before transistor Q6 can be drawn into conduction. This arrangement has been observed in practice to have worked in combination with the other noise avoidance features of the circuit to provide a highly reliable annunciator circuit.

In similar fashion, a low true signal at line 77 is impressed at the base of open collector NPN transistor Q5. The emitter of transistor Q5 is coupled via line 84 to the base of PNP transistor Q8. This line 84, in similar fashion as line 82, includes resistor R9 and diode D6. Thus configured, the voltage drop exhibited by diode D6 and open collector transistor Q5 (emitter-base junction reverse biased) requires that less than about 5 volts with respect to ground be applied to line 77 before transistor Q8 can be drawn into conduction from line 84. The emitter of transistor Q8 is coupled to plus power supply via line 88 and resistor R10, while the collector thereof at line 92 extends through bias resistor R11 to the base of NPN transistor Q9. Thus, with the application of logic signal of sufficiently small magnitude at line 77, transistor Q9 will be forwardly biased into conduction. Note that the plus power supply is again employed for "forcing" an active logic high into the system under quiescent conditions. Transistors Q7 and Q9 provide logic inputs to three chime designating networks comprising a single chime logic network 94, a double chime logic network 95, and a continuous chime logic network 96.

Assuming that a logic signal of sufficiently small magnitude has been applied to line 77 for a single chime or up elevator car condition, then, as above-described, transistor Q9 is forwardly biased into conduction. Note that the emitter of transistor Q9 is coupled via line 98 to ground through line 100, while the collector thereof is coupled to line 102. Resistor R12, coupled between line 92 at the base of transistor Q9 and line 100 improves the transistor's shut-off characteristics. Line 102 is shown coupled by line 104, containing resistor R13, to plus power supply through line 106 and through line 108 containing capacitor C4 to ground line 100 to provide a switch "debouncing" feature. With this arrangement, line 102 is normally at a logic high value due to the coupling therewith through resistor R13 and lines 104 and 106 to plus power supply. As transistor Q9 turns on, it is coupled to ground through lines 98 and 100 and capacitor C4 commences to discharge to a level representing a logic low. However, if, upon capacitor reading that low value, switch bounce occurs and the transistor is turned off, then capacitor C4 commences to charge through resistor R13 over a time constant selected such that the logic low level will not be disturbed. Assuming the logic low value at line 102 is retained, the resultant logic low value shown to extend through line 110 to an inverter 112, whereupon the signal is inverted for presentation along line 114 to NAND gate 116. The opposite input to gate 116 emanates from line 118 which extends, in turn, to the collector of transistor Q7. Additionally, line 118 is coupled to line 104 incorporating pull-up resistor R14 extending to plus power supply 106. Thus, inasmuch as transistor Q7 is off for the instant logic condition, the logic level at line 118 is high. The resultant condition at gate 116 provides a low logic at its output at line 120. Line 120 is sown to incorporate one diode of a grouping of three diodes D7-D9 comprising an OR function. From diode D7, line 120 extends to a timing network including capacitor C5 and resistor R15 which is coupled between line 120 and plus power supply. A second resistor R16 is seen coupled between that same plus power supply and line 120 on the opposite side of capacitor C5. Resistor R16 serves to discharge capacitor C5 through resistor R15 and positive power supply. With the arrangement shown, as line 120 momentarily assumes a low logic state, the capacitor C5 is charged through resistor R15 to change the input signal to one terminal of NAND gate 124 from a normally high logic level to a low logic level. The values of capacitor C5 and resistor R15 are selected to provide, for example, about a 10 millisecond time-out such that when line 120 reverts to a logic high value, the input to gate 124 will remain low for that 10 millisecond interval. That input to gate 124 then reverts to a logic high state. The opposite terminal input to gate 124 is provided at line 126 which, in turn, is coupled to a timing network 128 comprised of capacitor C6 and resistor R17. Network 128 is provided having the same time constant as network 127, i.e. 10 milliseconds. However, for the instant situation or condition, line 126 will remain at a logic high value by virtue of its connection through resistor R17 to plus power supply the resistor acting in a "pull-up" capacity. Accordingly, with the low-going transition at line 129, the output at line 130 of gate 124 will revert from a low to a high logic level for the noted 10 millisecond time constant interval of network 127 following the return of the output of gate 116 to a logic high level. In effect, network 127 serves as a one-shot function, preserving an actuating signal.

Line 130, at the output of gate 124 is seen to extend through bias resistor R18 to the base of NPN transistor Q10 (FIG. 2A). Thus, as line 130 transitions to a logic high value for the noted 10 millisecond interval, transistor Q10, correspondingly, is turned on. The emitter of transistor Q7 is coupled via line 132 to line 134 and ground while the collector thereof is coupled to line 136 which is also coupled to line 134 to effect a selective discharge of a timing capacitor C7. As the collector of transistor Q10 assumes a logic low state, transistor Q2 is drawn into conduction through resistor R19. Following the noted 10 millisecond interval, transistor Q10 is turned off and capacitor C7 commences to charge through resistor R19. With the initial turning on of transistor q2, full (saturation) power is made available at line 46 to effect the drive of crystal 44. However, the initially saturated condition of transistor Q2 immediately commences to charge as its base voltage rises in consonance with the charging of capacitor C7 through resistor R19. It is this base voltage variation which forms the amplitude variation to achieve a desired chime sound, for example, sounding as a "gong". Thus, an exponential decaying of amplitude in power asserted to the piezoelectric crystal 44 is achieved as capacitor C7 is charged.

Referring to FIG. 2B, when a short valid logic low actuating signal (sufficiently low with respect to the ground) is applied to input line 76 and a corresponding high logic level is forced with respect to line 77, an elevator car downward travel condition along with a command for a double chime situation obtains. As such, as earlier described, transistor Q7 is turned on and transistor Q9 remains off. Resistor R12' provides for enhanced turn-off of transistor Q7 in the manner of earlier described resistor R12. Capacitor C8, operating in conjunction with the resistor R14 provides a "debouncing" feature in identical fashion as the earlier described combination of capacitor C4 with resistor R13. The resultant logic is that the input to single chime network 94 gate 116 is provided as a low logic level at line 114 and, additionally, a low logic level at line 118. The output at gate 116 at line 120 then is at a high logic level to back bias diode D7. However, the inputs to NAND gate 136 of double chime logic network 95 will alter. In this regard, inasmuch as transistor Q9 is off, the logic high at line 102 will be asserted at one input gate 136. The opposite input thereto is derived from line 138 which extends through an inverter 140 to line 118. Accordingly, a high logic level is asserted to gate 136 from line 138 and the resultant output of gate 136 at line 142 becomes a logic low. Line 142 is coupled with diode D8 via line 144 and, as a consequence, the earlier-described logic for creating a first chime or gong sound is developed at line 120.

Network 95 then carries out the logic for creating the next successive chime sound. Line 142 is coupled via line 144 and OR function diode D8 to line 120. Thus, the initial low logic level at line 142 will result in the generation of a first chime as above-described. However, line 142 additionally is seen to be directed through resistor R20 to capacitor C9 which, in turn, is coupled to the input of inverter stage 146. Capacitor C9 normally is discharged in consequence of the positioning between resistor R20 (normally coupled to logic high at line 142) and resistor R21 and positive power supply. Thus, as line 142 transitions to a logic low state, capacitor C9 commences to charge through resistor R21 over a short time interval (20 millisecond). During this short interval, the input to inverter 146 is at a logic low state and the resultant output at line 148 is at a logic high state. This logic high value is inverted by inverter 150 to a logic low value at line 152 in order to sink the charge from a capacitor C10 of a timing network represented generally at 154. The low logic state at line 152 permits the discharge of capacitor C10 through low value (fast discharge) resistor R22 and forwardly biased diode D10. The double inverters 146 and 150 are employed for this purpose of sinking this capacitor C10 discharge. Following the short time-out of the resistor R21—capacitor C9 combination, line 152 reverts to a logic high state which reverse biases diode D10. Capacitor C10 then commences to charge through resistor R23 over an interval of about one second. As a consequence, the logic level at line 156 remains low for a one minute interval. Line 156 is seen directed to the input of inverter stage 158. Thus, during that one minute interval, the output of stage 158 at line 160 is at to a high logic level. As a consequence, capacitor C6 is discharging through resistor R17 to plus power supply. At the termination of the noted one second interval, line 160 assumes a low logic state causing a commencement of charge-up of capacitor C6 via resistor r17. The time constant of this combination is selected as about 10 microseconds and serves to retain line 126 at a low state during the same interval. Thus line 126 will have been held at a logic low state for about 10 microseconds which is reflected as a logic high state at line 130 to develop the second chime as described above.

Now looking to the operation of a continuous chime logic network 96, it may be recalled that a development of a continuous chime is called for with the assertion of a signal sufficiently low with respect to ground simultaneously at each of lines 76 and 77. This, in effect, causes both transistors Q7 and Q9 to turn on. A resultant logic low occurs at lines 118 while the logic level at line 114 is high such that the output of gate 116 at line 120 is a logic high. Simultaneously, the input at line 102 to gate 136 is a logic low and the opposite input thereto from line 138 is a logic high. Line 142, therefore, remains at a high logic state. However, the corresponding inputs to network 96 NAND gate 162 are logic highs. The output thereof for the instant condition at line 166 is a logic low which is inverted at inverter stage 168 to logic high state at its output line 170. The high logic level at line 170 serves to back-bias a diode D11 which, in turn, enables an oscillator circuit having a period of approximately 0.6 seconds as is represented generally at 172. Oscillator network 172 is shown to be formed of resistors R24 and R25 operating in conjunction with an inverter stage 174 and capacitor C11. The inverter stage 174, as well as resistor R25 are coupled through line 176 and diode D9 to line 120 of the multi-diode OR function. Thus, with the back biasing of diode D11, the input to inverter 174 is a logic high to created a logic low at the output thereof to permit the charging of capacitor C11 through resistor R25. Resistor R26 serves a current limiting function when the oscillator is disabled. As charging ensuès over the predetermined period of oscillation, the condition at inverter 74 inverts and oscillation continues in a manner causing the single chime function at line 120 to create requisite annunciation. Resistor R24 enhances the start-up of the oscillator function. As is apparent, when line 176 assumes a low logic state during oscillation, diode D9 is forwardly biased to cause the development of a chime in the manner of the single chime development. As line 176 reverts to a logic high level, of course, diode D9 is back biased and capacitor C5 is discharged.

The continuous chime is turned off upon the alteration of the logic input to lines 76 and 77. This effects the development of a logic low state at line 170 to disable the oscillator.

Because capacitor leakage will occur in conjunction with the drive circuits as shown, for example in conjunction with capacitor C7, low level tones or spurious noises may be evolved in the course of normal operation of the system. Accordingly, referring to FIG. 2A, an oscillator disable network is employed as is represented generally at 180. It may be recalled that when diode D4 at line 70 is back-biased, the oscillator network 60 is enabled. The selective control over the back-biasing of diodes D7, D8, or D9 is provided in response to the logic level of the output of gate 124 at line 130. Note that line 130 is connected through 182 to the input of an inverter stage 184 which, in turn, provides an inverted output at line 186 which is directed through diode D12 and low value resistor R27 to the input of an inverter stage 186. That input also is coupled via line 188 to the center of an RC network comprised of resistor R28 and capacitor C12 coupled between positive power supply and ground. With this arrangement, when line 130 is at a logic high, that logic high is directed through inverter 184 to provide a logic low at line 186. This permits the rapid discharge of capacitor C12 through low value resistor R27 and diode D12. Thus, for this condition, the output of stage 186 is high to back-bias diode D4 and provide a logic high value through resistor R29 to line 70 and enable the oscillator. However, with the transition of line 130 to a logic low value, diode D12 is back-biased and the timing network comprised of resistor R28 and capacitor C12 is permitted to charge over about a 1.5 second time interval. At the termination of this interval, the output of inverter stage 186 is low to permit conduction through diode D4 and effect the disablement of oscillator network 60. As so constructed, the oscillator network 60 is enabled for about 1½ seconds unless further commands for its functioning are received. However, the network 60 is positively or actively turned off in the absence of such command. Thus, a positive avoidance of leakage induced sounds is achieved with the invention.

Since certain changes may be made in the above-described apparatus without departing from the scope of the invention herein involved, it is intended that all matter contained in the description thereof or shown in the accompanying drawings shall be interpreted as illustrative and not in a limiting sense.

We claim:

1. An annunciator circuit for elevator systems wherein a piezoelectric crystal is energized to drive the diaphragm of a sounder selectively in response to two-bit logic low true input conditions, comprising:

input condition verification network means including first and second switching means respectively responsive to low logic conditions of first and second ones of said two-bit conditions only when said low true conditions are below a predetermined signal value with respect to ground to provide first and second unique verified low true signals;

drive means energizable from a source and coupled with said crystal for effecting the time limited, drive amplitude modulated energization thereof when enabled and oscillatively actuated;

oscillator means coupled with said drive means for effecting said actuation thereof when enabled from a disabled state;

first chime logic network means responsive to said first verified low true signal to derive a signal chime output condition serving to enable said drive means and said oscillator means for a singular interval of time;

second chime logic network means responsive to said second verified low true signal to derive said first logic network means single chime output condition and for deriving a double chime output condition serving to enable said drive means and said oscillator means after a predetermined interval of time subsequent to said derivation of said first logic network means single chime output condition;

third chime logic network means responsive to the simultaneous occurrence of said first and second verified low true signals for deriving said single chime output condition in a timed repetitive sequence.

2. The annunciator circuit of claim 1 including manually adjustable variable impedance means coupled intermediate said source and said crystal for selectively attenuating the level of energization thereof.

3. The annunciator circuit of claim 1 in which said input verification network means first switching means comprises:

first transistor means and a regulated source coupled thereto, said first transistor means conduction from said source in the presence of a control voltage below a predetermined value;

first voltage control network means coupled with said source and in controlling relationship with said first transistor means for deriving a first securing voltage level retaining said first transistor means in a non-conducting state and responsive to said low logic conditions below said predetermined signal value for deriving said control voltage below a predetermined value, and first logic switching means responsive to said first transistor means condition for deriving said first unique verified low true signal.

4. The annunciator circuit of claim 3 in which said first transistor means comprises a PNP transistor.

5. The annunciator circuit of claim 4 in which said first voltage control network means comprises a solid-state component exhibiting a Zener characteristic for deriving said first securing voltage level.

6. The annunciator circuit of claim 3 in which said input verification network means second switching means comprises:

second transistor means and a regulated source coupled thereto, said second transistor means conducting from said source in the presence of a control voltage below a predetermined value;

second voltage control network means coupled with said source and in controlling relationship with said second transistor means for deriving a second securing voltage level retaining said second transistor means in a non-conducting state and responsive to said low logic conditions below said predetermined signal value for deriving said control voltage below a predetermined value, and second logic switching means responsive to said second transistor means condition for deriving said second unique verified low true signal.

7. The annunciator of claim 6 in which said second transistor means comprises a PNP transistor.

8. The annunciator of claim 7 in which said second voltage control network means comprises a solid-state component exhibiting a Zener characteristic for deriving said first securing voltage level.

9. The annunciator of claim 8 including manually adjustable variable impedance means coupled intermediate said source and said crystal for selectively attenuating the level of energization thereof.

10. An annunciator circuit for use with piezoelectric crystal driven sounders comprising:

input condition verification network means including switching means actuable to drive an actuation signal in response to a switching condition of value predetermined with respect to ground and having a logic positive state output in response to said switching condition;

drive means energizable from a source and coupled with said crystal for effecting a time limited, drive amplitude modulated energization thereof when enabled and oscillatively actuated;

oscillator means coupled with said drive means, having enabled and disabled conditions, for actuating said drive means when in said enabled condition;

control means responsive to said input verification network means actuation signal to provide an annunciation signal enabling said drive means; and oscillator disable network means responsive to said input condition verification network means logic positive state for effecting said oscillator means disabled condition and responsive to said control means annunciation signal for effecting said oscillator means enabled condition.

11. The annunciator circuit of claim 10 including manually adjustable variable impedance means coupled intermediate said source and said crystal for selectively attenuating the level of energization thereof.

12. The annunciator circuit of claim 10 in which said input verification network means first includes switching means comprising:

first transistor means and a regulated source coupled thereto, said first transistor conducting from said source in the presence of a control voltage below predetermined value;

first voltage control network means coupled with said source and in controlling relationship with said first transistor means for deriving a first securing voltage level retaining said first transistor means in a non-conducting state and responsive to said switching condition below said predetermined signal value for deriving said control voltage below a predetermined value, and first logic switching means responsive to said first transistor means condition for deriving positive state output.

13. The annunciator circuit of claim 12 in which said first transistor means comprises a PNP transistor.

14. The annunciator circuit of claim 13 in which said first voltage control network means comprises a solid-state component exhibiting a Zener characteristic for deriving said first securing voltage level.

15. The annunciator circuit of claim 12 in which said input verification network means includes second switching means including:

second transistor means and a regulated source coupled thereto, said second transistor means conducting from said source in the presence of a control voltage below a predetermined value;

second voltage control network means coupled with said source and in controlling relationship with said transistor means for deriving a second securing voltage level retaining said second transistor means in a non-conducting state and responsive to said switching condition below said predetermined signal value for deriving said control voltage below a predetermined value, and second logic switching means responsive to said second transistor means condition for deriving said positive state output.

16. The annunciator circuit of claim 15 in which said second transistor means comprises a PNP transistor.

17. The annunciator circuit of claim 16 in which said second voltage control network means comprises a solid-state component exhibiting a Zener characteristic for deriving said first securing voltage level.

18. The annunciator circuit of claim 17 including manually adjustable variable impedance means coupled intermediate said source and said crystal for selectively attenuating the level of energization thereof.

* * * * *